US011583720B2

(12) United States Patent
Gedeon-Janvier

(10) Patent No.: US 11,583,720 B2
(45) Date of Patent: Feb. 21, 2023

(54) SELF-SPOTTING EXERCISE APPARATUS

(71) Applicant: Maxime Gedeon-Janvier, Inwood, NY (US)

(72) Inventor: Maxime Gedeon-Janvier, Inwood, NY (US)

( * ) Notice: Subject to any disclaimer, the term of this patent is extended or adjusted under 35 U.S.C. 154(b) by 0 days.

(21) Appl. No.: 17/535,074

(22) Filed: Nov. 24, 2021

(65) Prior Publication Data

US 2022/0193477 A1 Jun. 23, 2022

Related U.S. Application Data

(60) Provisional application No. 63/128,187, filed on Dec. 21, 2020.

(51) Int. Cl.
*A63B 21/078* (2006.01)
*A63B 71/00* (2006.01)
*A63B 21/062* (2006.01)

(52) U.S. Cl.
CPC ..... *A63B 21/062* (2013.01); *A63B 21/0783* (2015.10); *A63B 2071/0081* (2013.01)

(58) Field of Classification Search
CPC ..... A63B 21/06–08; A63B 21/0783
See application file for complete search history.

(56) References Cited

U.S. PATENT DOCUMENTS 4,650,186 A * 3/1987 McCreery ..... A63B 21/4005 482/104
4,875,676 A * 10/1989 Zimmer ..... A63B 21/4029 482/104
5,050,873 A * 9/1991 Jones ..... A63B 21/4047 482/138
5,273,504 A * 12/1993 Jones ..... A63B 23/1263 482/133
5,273,505 A * 12/1993 Jones ..... A63B 21/0615 482/133
5,788,614 A * 8/1998 Simonson ..... A63B 23/03525 482/136
5,813,951 A * 9/1998 Einsig ..... A63B 21/0615 482/110
6,471,624 B1 * 10/2002 Voris ..... A63B 21/078 482/136

(Continued)

FOREIGN PATENT DOCUMENTS

KR 20220068897 A * 5/2022
WO WO-2005070503 A1 * 8/2005 ..... A63B 21/00181

*Primary Examiner* — Nyca T Nguyen
(74) *Attorney, Agent, or Firm* — Wendy W. Koba, Esq.

(57) ABSTRACT

A self-spotting exercise apparatus is formed to include a pair of weight-bearing arms that are attached to a back frame assembly of the apparatus by a pair of double-hinge components. The double-hinge configuration provides a full range of motion for the weight-bearing arms with respect to the "fixed" apparatus itself. The opposing end terminations of the weight-bearing arms are configured to support weight plates (which may be changed out, as desired), with the weight-bearing arms also including a pair of handgrips for the user to hold as he/she moves the weight-bearing arms during an exercise routine. Self-spotting is provided by the use of a foot-activated motion bar, which is attached to a pair of vertical support posts that hold the distal ends of the extended arms when not in use.

17 Claims, 7 Drawing Sheets

(56) References Cited

U.S. PATENT DOCUMENTS

| | | | | |
|---|---|---|---|---|
| 6,689,027 | B1 * | 2/2004 | Gardikis, Jr. | A63B 21/078 482/142 |
| 6,860,840 | B2 * | 3/2005 | Carter | A63B 21/0615 482/142 |
| 6,905,446 | B2 * | 6/2005 | Greenland | A63B 21/078 482/137 |
| 6,926,649 | B2 | 8/2005 | Slawinski | |
| 7,070,547 | B1 | 7/2006 | Pater | |
| 7,112,162 | B2 * | 9/2006 | Greenland | A63B 21/06 482/97 |
| 7,226,400 | B1 * | 6/2007 | Gedeon-Janvier | A63B 21/4031 482/106 |
| 7,938,761 | B2 * | 5/2011 | Simonson | A63B 21/0615 482/136 |
| 9,168,412 | B2 | 10/2015 | Towley, III et al. | |
| 9,327,160 | B2 | 5/2016 | Tauriainen | |
| 9,884,239 | B2 | 2/2018 | Kay et al. | |
| 10,016,646 | B2 | 7/2018 | Butler | |
| 10,646,744 | B2 * | 5/2020 | Steenekamp | A63B 1/005 |
| 10,926,125 | B1 * | 2/2021 | Candler | A63B 21/08 |
| 11,173,337 | B2 * | 11/2021 | Jones | A63B 17/00 |
| 2002/0111258 | A1 * | 8/2002 | Slattery | A63B 21/4029 482/142 |
| 2007/0049472 | A1 | 3/2007 | Hummer, Jr. | |
| 2007/0082795 | A1 * | 4/2007 | Murray | A63B 21/4029 482/104 |
| 2010/0216610 | A1 * | 8/2010 | Gedeon-Janvier | A63B 21/078 482/94 |
| 2014/0073493 | A1 | 3/2014 | Parish et al. | |
| 2014/0187391 | A1 * | 7/2014 | Kelly | A63B 21/0724 482/104 |

* cited by examiner

SELF-SPOTTING EXERCISE APPARATUS

CROSS-REFERENCE TO RELATED APPLICATION

This application claims the priority benefit of U.S. Provisional Application No. 63/128,187, filed Dec. 21, 2020 and herein incorporated by reference.

TECHNICAL FIELD

The present invention relates to self-spotting exercise apparatus and, more particularly, to an exercise apparatus that simulates the complete range of motion available with dumbbells by using weight plates that are positioned on double-hinged extended arms that may be maneuvered by the user within requiring the assistance of a spotter.

BACKGROUND OF THE INVENTION

There are many different types of exercise machines that allow an individual to work out with weight plates, usually in the form of a barbell apparatus. However, the range of motion is typically limited to a small range of up-and-down motion as an individual lays on a bench and raises/lowers their arms. Moreover, this type of apparatus requires the assistance of a spotter to help the individual grip the bar and begin an exercise routine, as well as guide the individual at the end of the session to return the bar to the included support rack. Serious injury may otherwise result if an individual attempted to use this apparatus without a spotter's assistance.

Other types of weight-based exercise practices may be considered as "self-spotting", such as performing an exercise routine by using free weights, such as a pair of dumbbells. Advantageously, working out with dumbbells allows an individual to move the weights through a range of motion that is limited only by the person's ability to move the dumbbell in various directions. However, in order to train using a variety of different weights, the individual needs to constantly switch out the specific dumbbell set being used.

SUMMARY OF THE INVENTION

The needs remaining in the art are addressed by the present invention, which relates to self-spotting exercise apparatus and, more particularly, to an exercise apparatus that simulates the complete range of motion available with dumbbells by using weight plates that are positioned on double-hinged extended arms that may be maneuvered by the user without requiring the assistance of a spotter.

In accordance with the principles of the present invention, a self-spotting exercise apparatus is formed to include a pair of weight-bearing arms that are attached to a back frame assembly of the apparatus by a pair of double-hinge components. The double-hinge configuration provides a full range of motion for the weight-bearing arms with respect to the "fixed" apparatus itself. The opposing end terminations of the weight-bearing arms are configured to support weight plates (which may be changed out, as desired), with the weight-bearing arms also including a pair of handgrips for the user to hold as he/she moves the weight-bearing arms during an exercise routine. Self-spotting is provided by the use of a foot-activated motion bar, which is attached to a pair of vertical support posts that hold the distal ends of the extended arms when not in use. In particular, the individual is able to use the motion bar to move the support posts out of the area where the weight-bearing arms may move during exercise, with a similar foot-controlled action used to bring the support posts back into the initial "rest" position when finished exercising.

An exemplary embodiment of the present invention takes the form of a self-spotting exercise apparatus that includes a base frame assembly, a back frame assembly, a bench supported between the frames, and a pair of weight-bearing arms coupled to the back frame assembly. The base frame assembly itself includes a motion bar disposed in a horizontal position, a pair of vertical support posts attached to opposing end terminations of the motion bar, and a foot-activated pedal attached to the motion bar for controlling the position of the pair of vertical support posts between a rest position and an exercise position, the combination of the motion bar and foot-activated pedal providing the capability of performing exercises without assistance. The bench is disposed over the base frame and positioned such that pair of vertical support posts are positioned at opposing side locations along the length of the bench, with the back frame assembly attached to a head-end of the bench. Each weight-bearing arm includes a double-hinge component attached to a proximal end thereof and coupled to the back frame assembly, and further includes a weight plate support pin and a handgrip, both the weight plate support pin and the handgrip disposed in proximity to an opposing, proximal end of the weight-bearing arm.

Other and further embodiments of the present invention will become apparent during the course of the following discussion and by reference to the accompanying drawings.

BRIEF DESCRIPTION OF THE DRAWINGS

Referring to the drawings, where like numerals represent like parts in several views.

DETAILED DESCRIPTION

Figure 1:
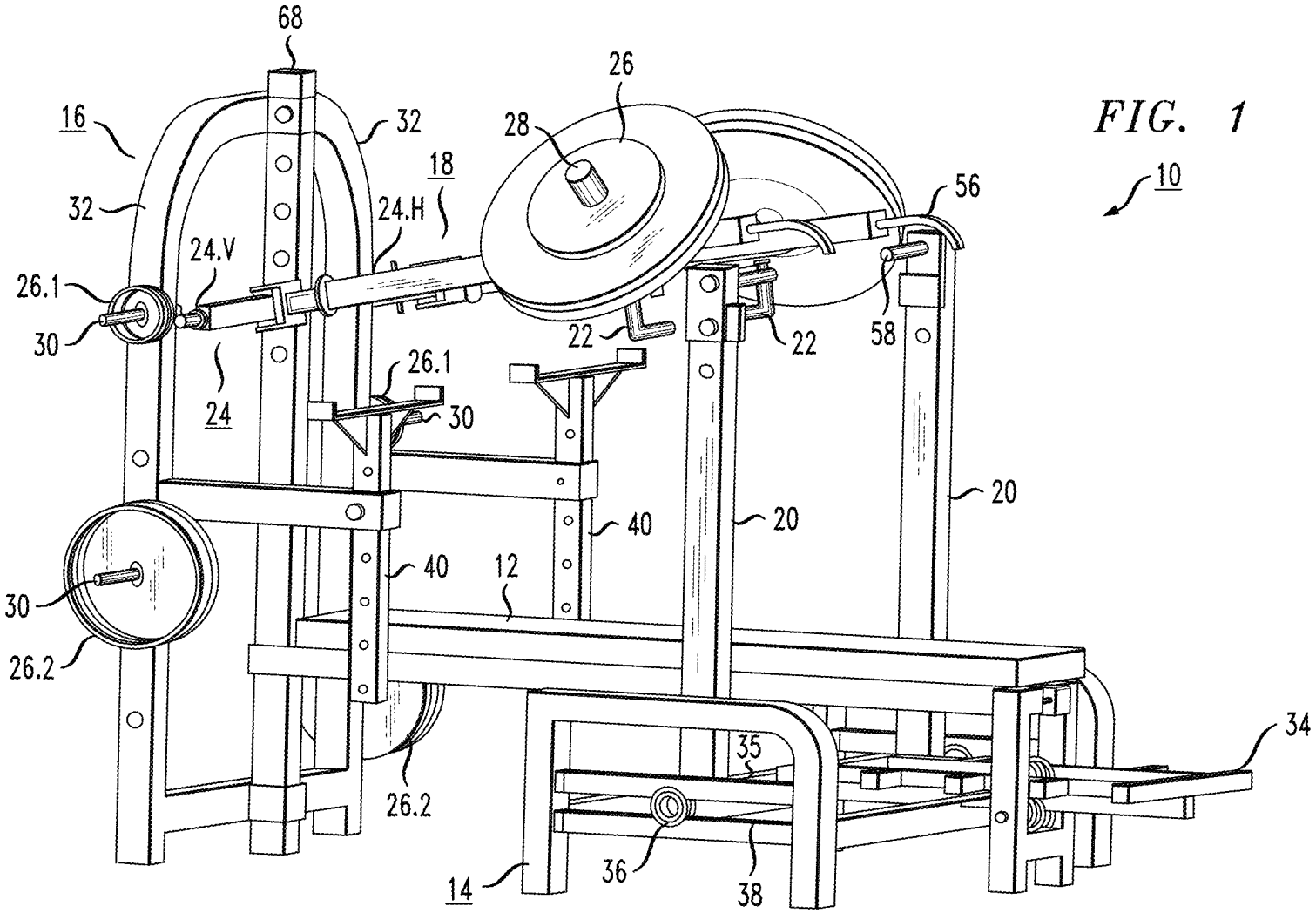
FIG. 1 is an isometric view of an exemplary embodiment of the self-spotting exercise apparatus formed in accordance with the present invention.

FIG. 1 is an isometric view of an exemplary self-spotting exercise apparatus 10 formed in accordance with the principles of the present invention. As will be described in detail below, apparatus 10 includes a bench 12 that is supported between a base frame assembly 14 and a back frame assembly 16. A pair of weight-bearing arms 18 is attached to back frame assembly 16 in a manner described in detail below so that an individual may recline on bench 12, grip weight-bearing arms 18 and move them through a full range of motion (i.e., simulating the capability of exercising with dumbbells) as part of an exercise routine. Base frame assembly 14 includes a pair of vertical support bars 20 that are used to hold weight-bearing arms 18 in place when apparatus 10 is not in use (i.e., a "rest" position). A pair of handgrips 22 is attached near the distal end terminations of weight-bearing arms 18, where the reclined individual initiates an exercise routine by holding onto handgrips 22, followed by lifting arms 18 off of vertical posts 20 and beginning his/her workout routine. With this basic understanding of the main components of self-spotting exercise apparatus 10, the details of the various elements will now be described in the following paragraphs.

An aspect of the present invention is to provide the ability for an individual to move weight-bearing arms 18 through a full range of motion, which is often not possible with traditional weight benches utilizing weight plates attached to opposing ends of a barbell. In particular, this full range of motion is provided by a double-hinge arrangement 24 that is used to connect each weight-bearing arm 18 to back frame assembly 16 (i.e., a first double-hinge arrangement 24.1 to connect the "right-hand" weight-bearing arm 18R to back frame assembly 16, and a second double-hinge arrangement 24.2 to connect the "left-hand" weight-bearing arm 18L to back frame assembly 16). For the sake of simplicity, the following discussion will at times refer to a single "double-hinge arrangement 24", a single "weight-bearing arm 18", or the like, with the understanding that a pair of such elements is necessarily employed to configure both the right-hand and left-hand sides of apparatus 10. Indeed, by virtue of using separate double-hinge arrangements 24.1, 24.2, an individual is able to independently control the movements of weight-bearing arms 18R, 18L (for example, holding one arm stationary while moving the other).

Continuing with reference to FIG. 1, a pair of weight plates 26 is shown as positioned in place over weight pins 28 located near the distal ends of weight-bearing arms 18. While fixedly held in place during a workout, weight plates 26 may be removed and replaced by other plates of a different weight value. As mentioned above, a feature of the present invention is the utilization of back frame assembly 16 as a location for storing extra weight plates that are not in use (as opposed to requiring a storage area separate from the apparatus itself, as necessary in the prior art when exercising with conventional dumbbells). Here, pairs of extra weight plates 26.1, 26.2 are positioned over frame pins 30 located along the side beams 32 of back frame assembly 16.

When an individual has attached the selected weight plates 26 and is ready to begin a self-spotted exercise routine, the next step is to lay down on bench 12 and get properly and comfortably situated, checking to make sure that handgrips 22 are accessible and easily within reach. As will be described in detail below, weight-bearing arms 18 and handgrips 22 may be formed to be adjustable (in length and position, respectively) so that an individual may also check the proper sizing and location of these elements before beginning a routine. At this point in time, weight-bearings arms 18 are located in a "rest" position on support posts 20, as shown in FIG. 1. When the individual is ready to begin an exercise routine, he/she raises weight-bearing arms 18 off of support posts 20 and uses his feet to push forward against a foot pedal component 34 of base frame assembly 14. Foot pedal component 34 is attached to a motion bar 35 within base frame assembly 14. In this particular embodiment of the present invention, motion bar 35 is itself attached to a pair of rollers 36 that ride within a pair of travel channels 38 formed in base frame assembly 14. Support posts 20 are attached to motion bar 35 so that as an individual pushes foot pedal component 34 forward (having previously raised weight-bearing arms 18 off of the support posts), support posts 20 will travel forward as well (yet remain within the confines of base frame assembly 14). This second position for support posts 20 is referred to at times as their "exercise position", meaning that support posts 20 are removed from the exercise area for the duration of the individual's exercise program.

Figure 2:
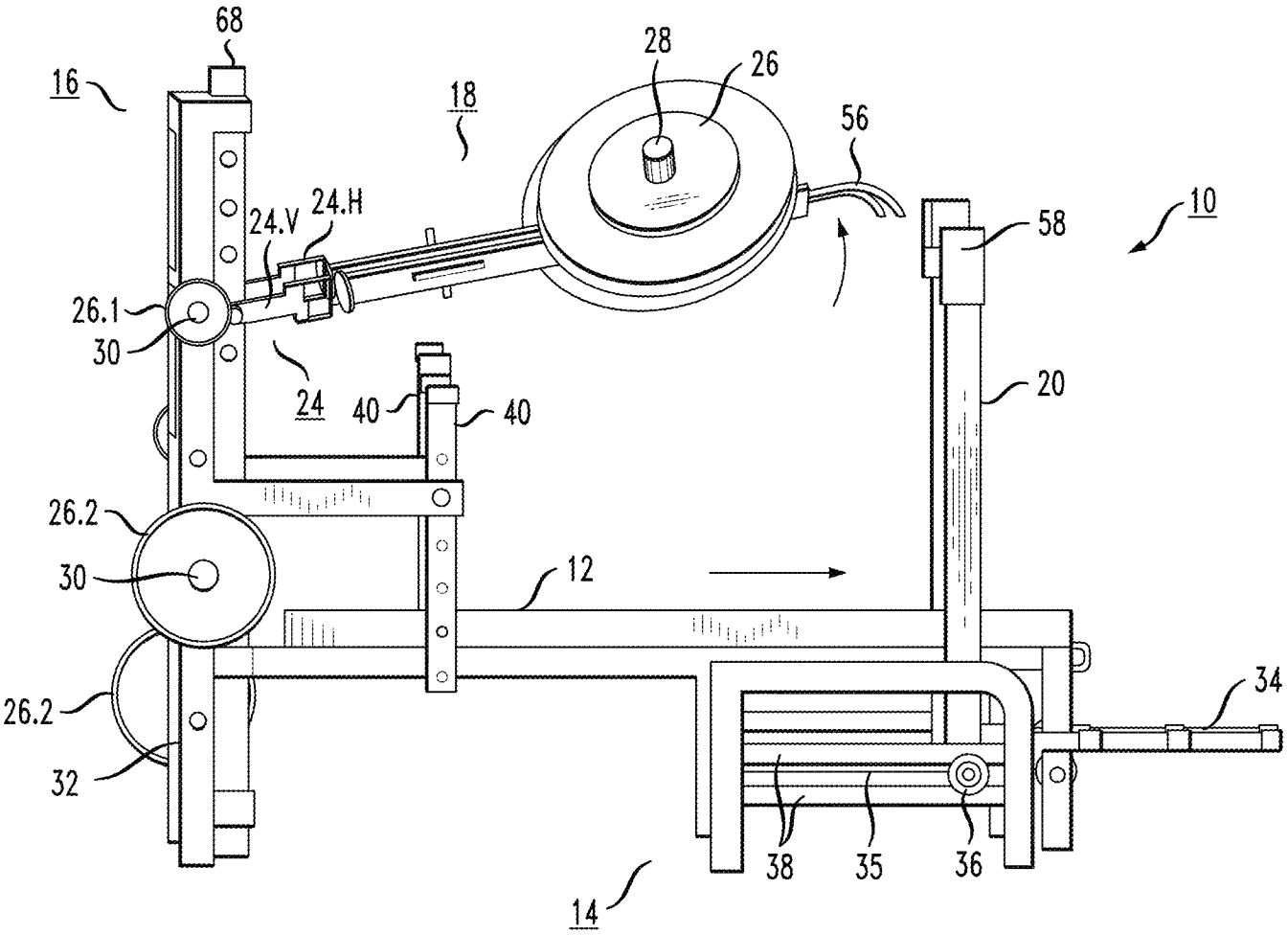
FIG. 2 is a side view of the same embodiment as shown in FIG. 1, in this case with support posts being moved into the "exercise" position by the included foot-activated components.

FIG. 2 is a side view of apparatus 10, showing foot pedal component 34, motion bar 35 and attached supports posts 20 after being pushed forward into the "exercise position" by the action of the individual's foot. The movement of support posts 20 forward into this "exercise position" is important, as mentioned above, in keeping them out of the way of the possible range of motion of weight-bearing arms 18 during a workout routine. The ability of the individual to move the support posts out of the way via foot motion thus eliminates the need to have another person standing by to assist when beginning (or ending) a routine. Indeed, when an individual has completed a workout routine, he/she then uses their feet to pull foot pedal component 34 back toward them, stopping when support posts 20 are back in place to hold weight-bearing arms 18 in the "rest" position.

Figure 3:
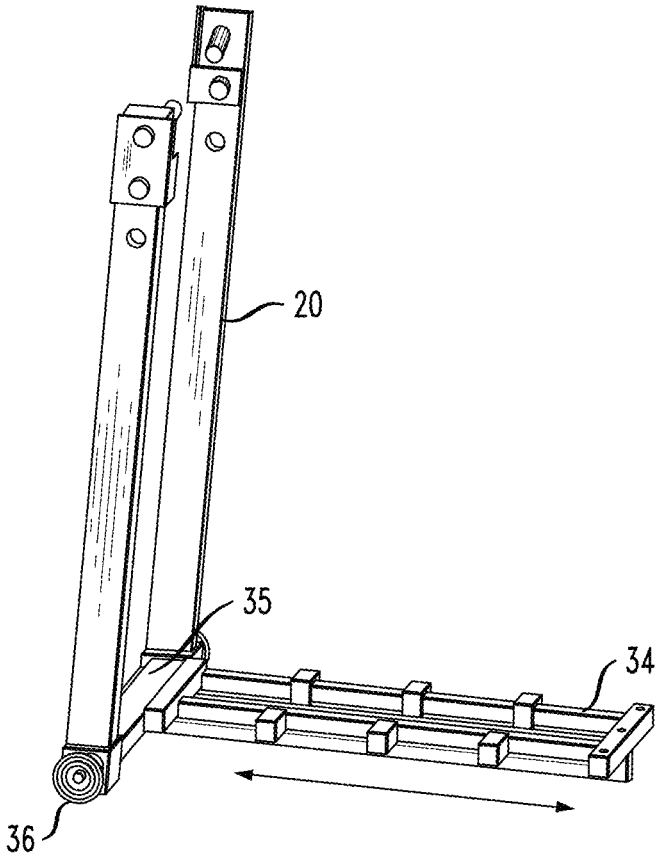
FIG. 3 illustrates the individual components used to accomplish the movement of the support posts between a rest position and the exercise position, providing the ability for the exercise apparatus to be used as a "self-spotting" apparatus.

FIG. 3 is an isometric view of the combination of support posts 20, rollers 36, motion bar 35, and foot pedal component 34, with the double-headed arrow indicating (for this embodiment) the back-and-forth movement of support posts 20 as controlled by an individual's feet engaging with component 34. Returning to the discussion of FIG. 1, self-spotting weight training apparatus 10 is shown as further comprising a pair of emergency stop supports 40. Supports 40 are used as "emergency" support posts for holding weight-bearing arms 18 if an individual is too fatigued to use foot pedal component 34 to return support posts 20 to their original "rest" position.

As an alternative to the translational forward/return motion provided by the combination of motion bar 35 and rollers 36, the positioning of support posts 20 may be configured to pivot (i.e., lean forward and back), under control of foot pedal component 34. For this alternative, a pair of pivot members and attached link bars may be used to rotate support posts 20 downward (i.e., toward bench 12) and out the way during an exercise routine. As with the translational movement embodiment, the individual's foot action may be used to return support posts 20 to their vertical position (i.e., the "rest" position).

Figure 4:
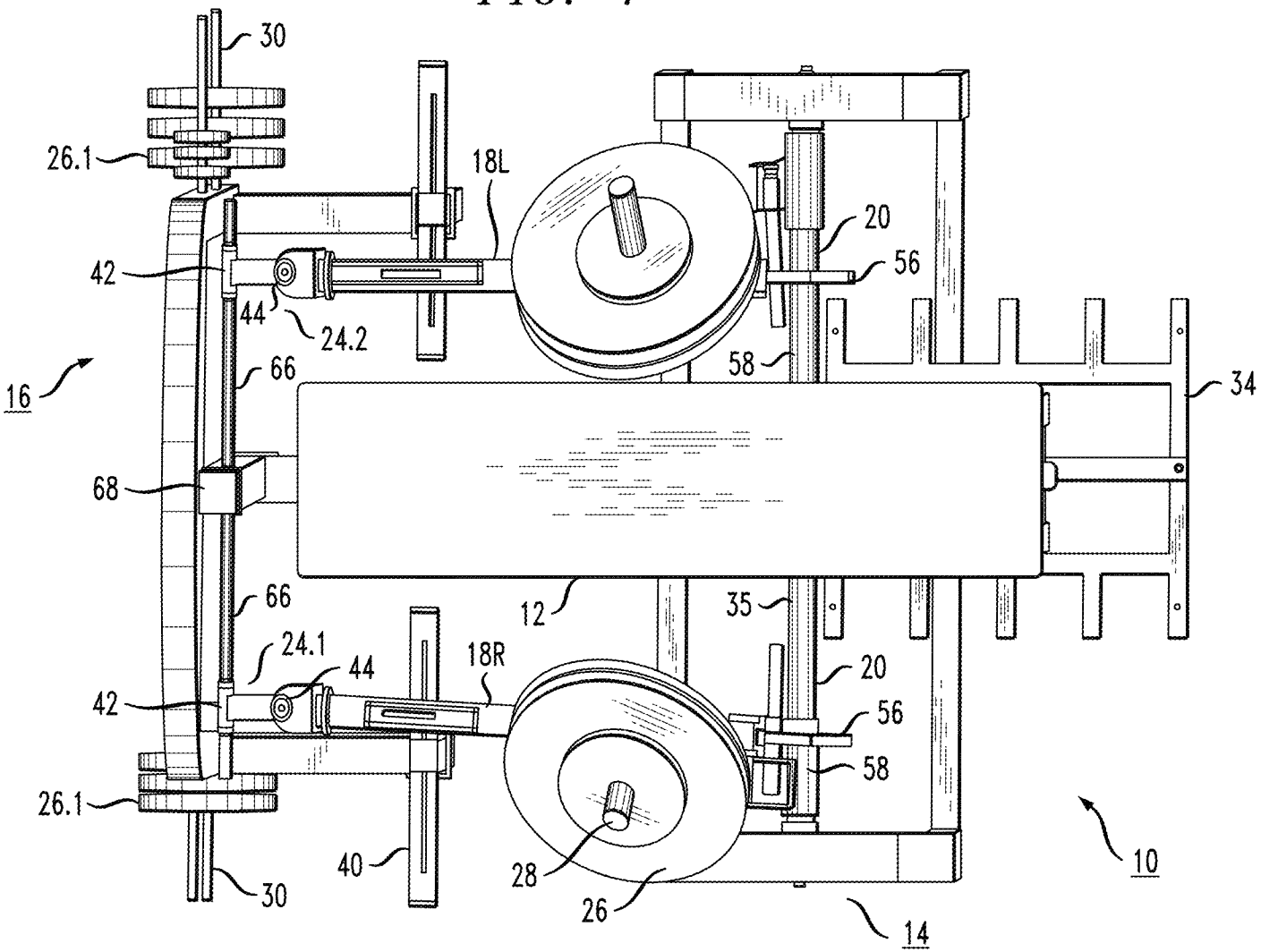
FIG. 4 is a top view of the self-spotting exercise apparatus of FIG. 1, clearly illustrating the paired arrangement of left-hand components and right-hand components as positioned on either side of the bench.

FIG. 4 is a top view of self-spotting weight training apparatus 10, which clearly shows right-hand/left-hand paired nature of the various components forming apparatus 10. In particular, both right-hand weight-bearing arm 18R and left-hand weight-bearing arm 18L are clearly shown in this view, as well as first double-hinge 24.1 used to attach arm 18R to back frame assembly 16 and second double-hinge 24.2 used to attach arm 18L to back frame assembly 16. An aspect of the present invention, as mentioned above, is to provide a weight training apparatus where routines using weight plates (as opposed to dumbbells) may be used in movements through the entire range of motion of the individual. Hinges 24 provide that desired range of motion.

Figure 5:
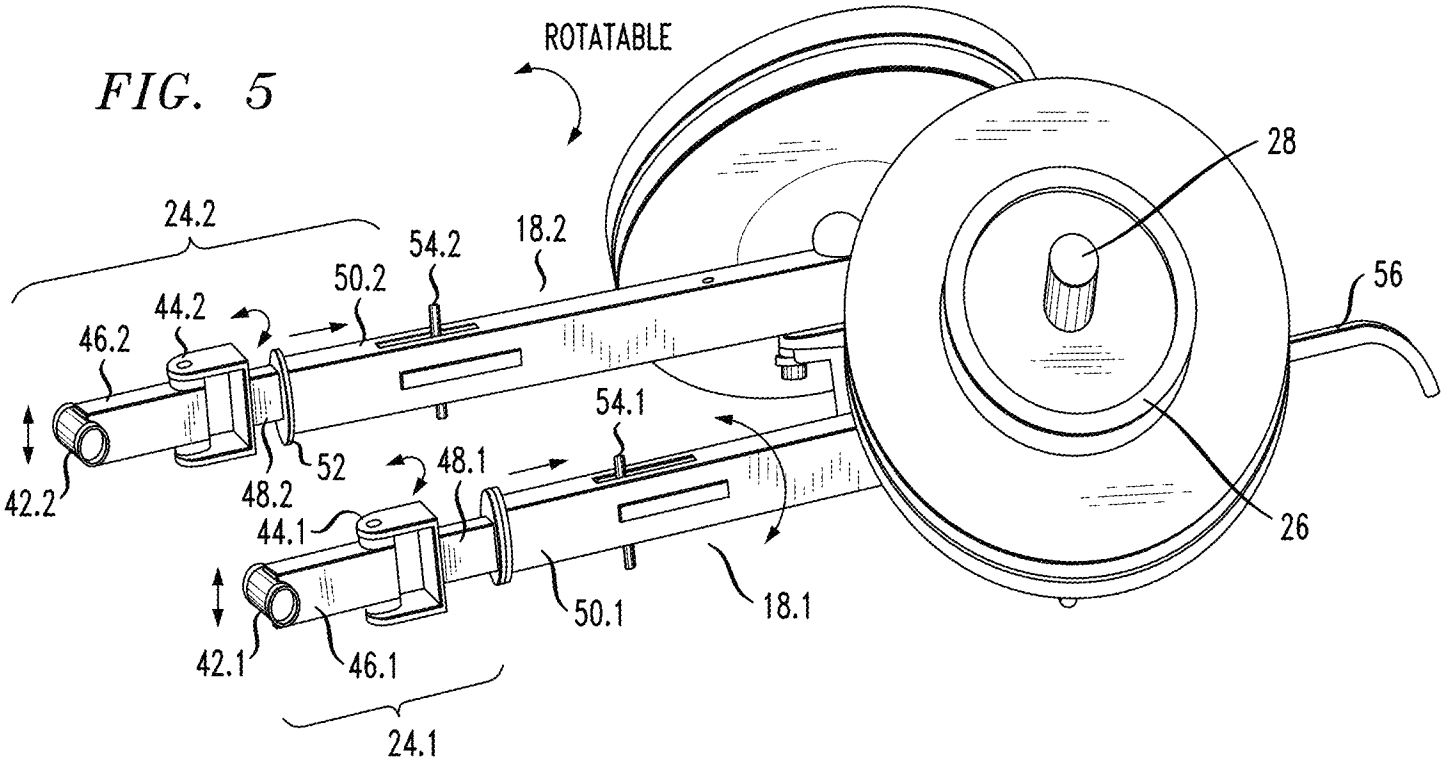
FIG. 5 is an enlarged view of the pair of weight-bearing arms that are maneuvered by an individual during an exercise session, illustrating in particular the double-hinge arrangement used to attach the weight-bearing arms to the back frame assembly of the apparatus in a manner that provides a free range of motion of the weight-bearing arms (simulating the movement capabilities of dumbbells), this view also showing an adjustable-length configuration of the arms (in particular, showing a pair of telescoping arms)

Reference is made to FIG. 5 in addition to FIG. 4 for this understanding, where FIG. 5 is an enlarged viewing of weight-bearing arms 18 and clearly shows the individual components forming first and second double-hinge arrangements 24.1, 24.2. In accordance with the present invention, each double-hinge arrangement 24 comprises a vertically-oriented hinge 42 and a horizontally-oriented hinge 44, with a cross-member 46 joining the hinges together in the manner best shown in FIG. 5. Working together, hinges 42 and 44 thus provide complete motion of weight-bearing arms 18 in free space (as compared to conventional weight benches where an individual has only a limited vertical space through which the bar may be raised and lowered). In particular, this hinging arrangement also provides rotational movement of each weight-bearing arm 18 (as shown by the double-ended arrows in FIG. 5). Additionally, the use of separate hinge configurations for each weight-bearing arm 18 allows for the individual to move one weight-bearing arm independent of the other; for example, holding weight-bearing arm 18L stationary while moving weight-bearing arm 18R through a range of motion (again, simulating the independent nature of exercising with dumbbells).

The particular embodiment of weight-bearing arms 18 as shown in FIG. 5 illustrates an arrangement where the length of weight-bearing arms 18 may be adjusted to account for the size of the individual using apparatus 10. In this case, each weight-bearing arm 18 is formed of a pair of telescoping arm sections 48 and 50, where inner arm section 48 is sized to fit within a properly-dimensioned aperture 52 formed in outer arm section 50. Preferably, arm sections 48 and 50 comprise a rectangular cross-section (as opposed to being formed of rounded pipes), since the rectangular form is considered to add stability to apparatus 10 and prevent weight-bearing arms 18 to perhaps rotate in a manner not well-controlled by the individual. The use of paired telescoping sections thus allows for the length L of weight-bearing arms 18 to be adjusted by moving inner arm section 48 with respect to outer arm section 50 until the desired length (for the individual preparing to use the apparatus) has been achieved. Various arrangements well-known in the art may be used to fixedly hold the position of inner section 48 with respect to outer section 50. In the particular embodiment as shown in FIGS. 4 and 5, each arm section is formed to include several apertures and when the proper length adjustment is completed, a fixing pin 54 is used to secure the telescoping configuration.

FIGS. 4 and 5 also show end terminations 56 that are included on the distal ends of weight-bearing arms 18 (that is, on the ends opposite of the distal location of double hinges 24). End terminations 56 are particularly configured to fit over similar terminations 58 formed at the top ends of support posts 20 and thus hold weight-bearing arms 18 in the "rest" position when not in use.

Figure 6:
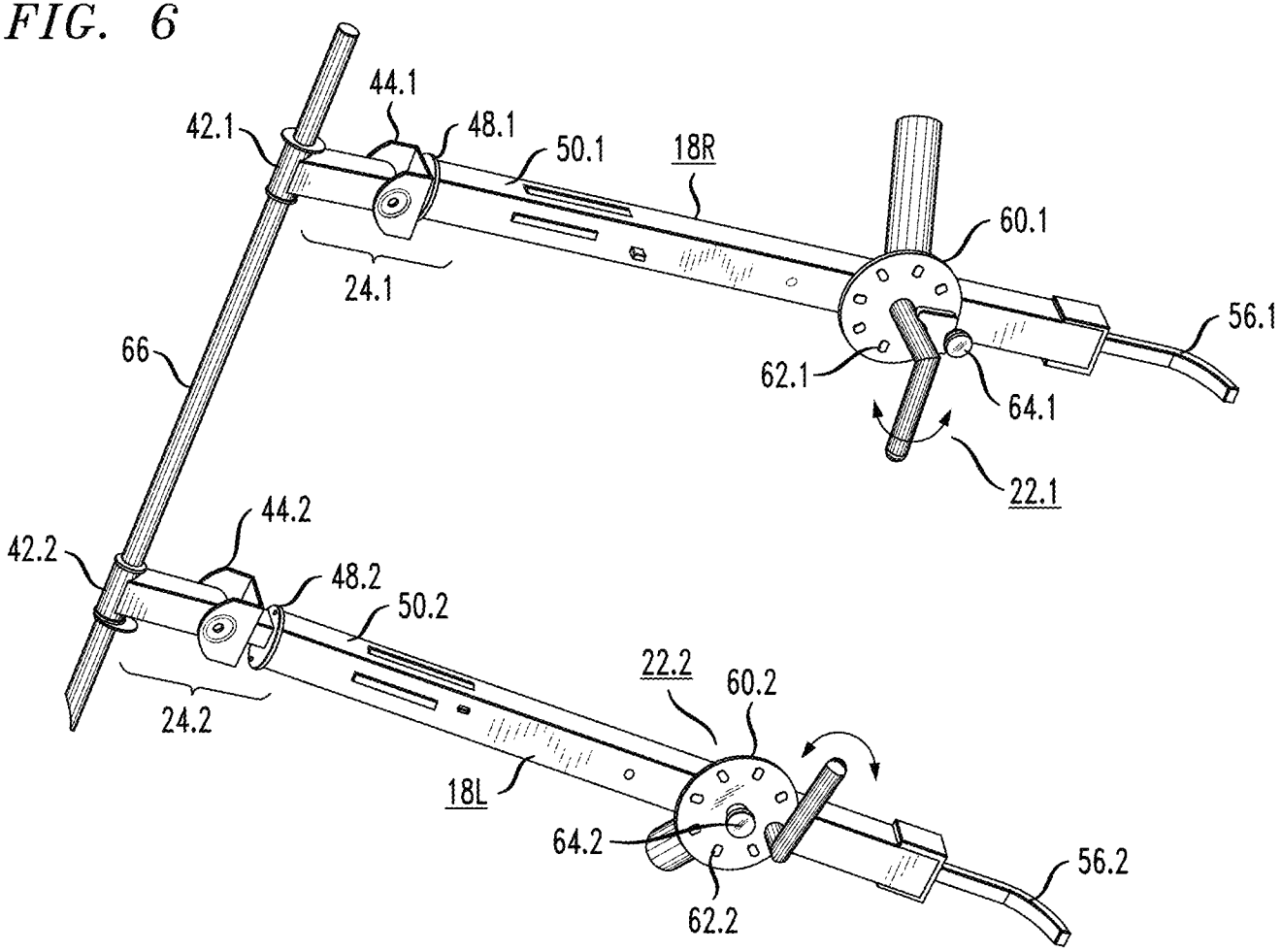
FIG. 6 is an enlarged view from the underside of the pair of weight-bearing arms of FIG. 5, in this view showing the position of the handgrips with respect to the weight plates near the proximal ends of the arms.
Figure 7:
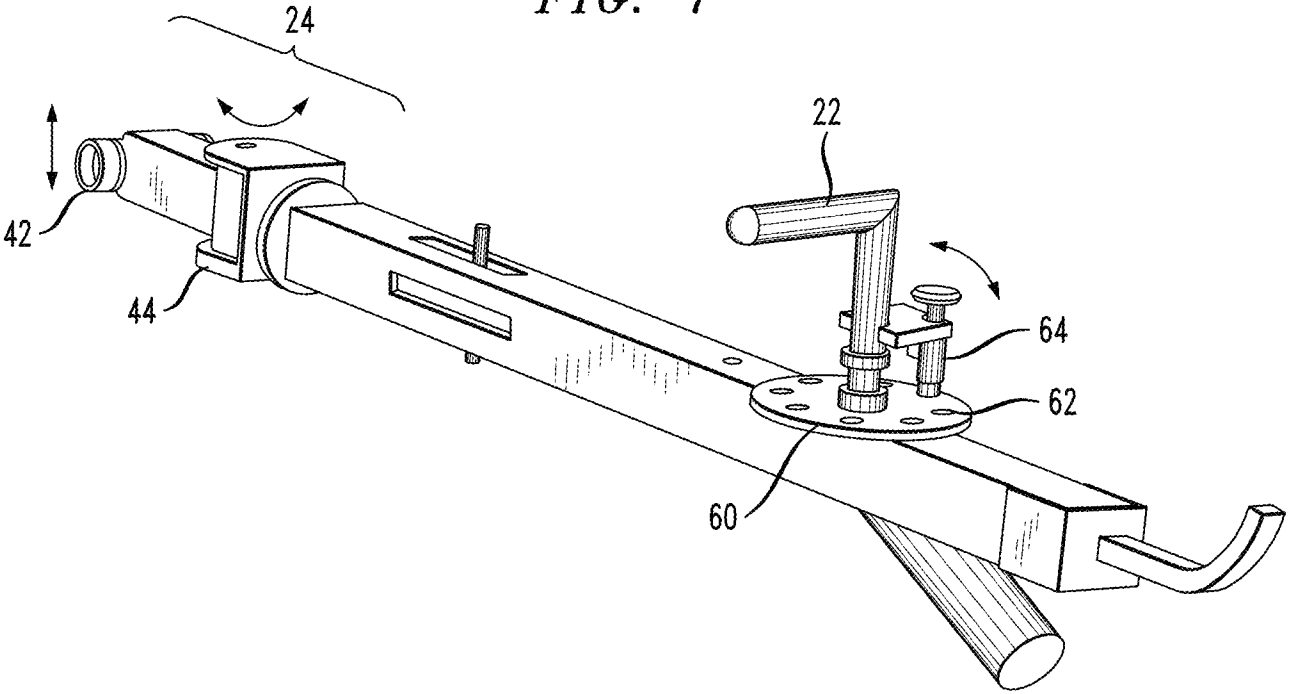
FIG. 7 is an enlarged view of one weight-bearing arm, with the same orientation as the view of FIG. 6, illustrating in particular a component that is able to adjust the position of the handgrips so as to provide an optimum arrangement for the user.

FIG. 6 is an isometric view from the underside of weight-bearing arms 18, where this particular view illustrates location of handgrips 22 and shows an exemplary embodiment that allows for the orientation of handgrips 22 (with respect to weight-bearing arms 18) to be adjusted in a manner that allows for the individual to find his/her optimum positioning. FIG. 7 is an enlarged view from the underside of a single weight-bearing arm 18, best showing the individual components used to provide the adjustable positioning of handgrips 22. Referring to both FIGS. 6 and 7, each position-adjustable handgrip 22 is shown as attached to its associated weight-bearing arm 18 via a circular plate 60 that is permanently affixed to weight-bearing arm 18. Circular plate 60 is formed to include a set of fitting position holes 62 around its periphery. Each handgrip 22 is placed over a central spindle of plate 60 and attached to a spring pin 64, as best shown in FIG. 7. Spring pin 64 is sized to fit within the set of holes 62 formed around the periphery of circular plate 60. Therefore, in order to adjust the position of handgrips 22, an individual may rotate spring pin 64 (and, therefore, attached handgrip 22) across the set of holes 62 until attached handgrip 22 is positioned at a comfortable location. Once this location is found, spring pin 64 is released to lower into the associated fitting position hole 62. It is to be understood that spring pin 64 is a removable/retractable element so that an individual may re-adjust the position or more likely, the next individual to use apparatus 10 may re-position handgrips 22 to a location best-suited for them.

Also shown in FIGS. 6 and 7 is a connector pipe 66 (circular in cross-section) that is disposed through vertical hinge elements 42.1, 42.2. Connector pipe 66 is used to provide the connection between weight-bearing arms 18 and back frame assembly 16. In particular, and as shown in FIGS. 1, 2, and 4, connector pipe 66 is attached to a vertical frame beam 68 that is positioned at the midpoint of back frame assembly 16. As noted above, this arrangement allows for independent movement of each weight-bearing arm 18 so as to best simulate the free range of motion available when exercising with dumbbells.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

What is claimed is:

1. A self-spotting exercise apparatus, comprising:

a base frame assembly including:

a motion bar disposed in a horizontal position;

a pair of vertical support posts attached to opposing end terminations of the motion bar; and a foot-activated pedal attached to the motion bar for controlling the position of the pair of vertical support posts between a rest position and an exercise position, the combination of the motion bar and foot-activated pedal providing the capability of performing exercises without assistance;

a bench disposed over the base frame and positioned such that the pair of vertical support posts are positioned at opposing side locations along the length of the bench;

a back frame assembly attached to a head-end of the bench; and a pair of weight-bearing arms, each weight-bearing arm including a double-hinge component attached to a proximal end thereof and coupled to the back frame assembly, each weight-bearing arm further including a weight plate support pin and a handgrip, both the weight plate support pin and the handgrip disposed in proximity to an opposing, proximal end of the weight-bearing arm.

2. The self-spotting exercise apparatus as defined in claim 1 wherein each double-hinge component includes a first hinge allowing for vertical movement of the associated weight-bearing arm and a second hinge allowing for horizontal, rotational movement of the weight-bearing arm, a separate cross member attaching the first hinge to the second hinge in a manner such that the combination of the first and second hinges creates a free range of motion including rotational motion for the attached weight-bearing arm simulating dumbbell movement capability.

3. The self-spotting exercise apparatus as defined in claim 2, the self-spotting exercise apparatus further comprising:

a connector pipe disposed in a horizontal orientation and attached to the back frame assembly, the connector pipe having an outer diameter of a size that accommodates the positioning of each double-hinge component to surround the connector pipe, providing movable attachment of the pair of weight-bearing arms to the back frame assembly.

4. The self-spotting exercise apparatus as defined in claim 1, wherein the base frame assembly further comprises:

a pair of rollers disposed at opposing end terminations of the motion bar; and a pair of translation channels for supporting the pair of rollers in a one-to-one configuration, wherein the attached foot-activated pedal provides back-and-forth translational movement of the support posts between the rest position and the exercise position, wherein the exercise position is properly located so as to prevent interference between the pair of support posts and the pair of weight-bearing arms during an exercise session.

5. The self-spotting exercise apparatus as defined in claim 1, wherein the base frame assembly further comprises:

a pair of pivot pins disposed at opposing end terminations of the motion bar; and a pair of rotatable links, each rotatable link coupled between a pivot pin and associated support post, wherein the attached foot-activated pedal provides rotating upward and downward movement of the support posts between the rest position and the exercise position, wherein the exercise position is properly located so as to prevent interference between the pair of support posts and the pair of weight-bearing arms during an exercise session.

6. The self-spotting exercise apparatus as defined in claim 1 wherein the back frame assembly further comprises one or more frame pins for supporting weight plates when not in use.

7. The self-spotting exercise apparatus as defined in claim 1 wherein the pair of weight-bearing arms comprise length-adjustable arms.

8. The self-spotting exercise apparatus as defined in claim 7 wherein the pair of weight-bearing arms comprise a pair of telescoping arms, each arm including at least two separate telescoping sections with a first telescoping section formed to move back and forth within the interior of a second telescoping section to adjust the overall length of the weight-bearing arm.

9. The self-spotting exercise apparatus as defined in claim 8 wherein the first and second telescoping sections comprise rectangularly-shaped arms.

10. The self-spotting exercise apparatus as defined in claim 1 wherein the pair of handgrips comprise a pair of adjustable-position handgrips.

11. The self-spotting exercise apparatus as defined in claim 10 wherein each weight-bearing arm of the pair of weight-bearing arms further comprises:

a circular plate attached to a handgrip location along the weight-bearing arm, the circular plate including a plurality of fitting position holes formed around an aperture thereof, wherein the handgrip is positioned over a central spindle attached to the circular plate; and a fixing pin attached to the handgrip and disposed to mate with a selected fitting position hole, wherein the fixing pin is rotated from location over one fitting position hole to another so as to adjust the position of the attached handgrip until an acceptable position of the handgrip with respect to the weight-bearing arm is achieved, the fixing pin thereafter inserted into the selected fitting position hole.

12. The self-spotting exercise apparatus as defined in claim 11 wherein each fixing pin comprises a spring-loaded pin for maintaining a fixed position with its associated selected fitting position hole.

13. The self-spotting exercise apparatus as defined in claim 1 wherein the apparatus further comprises:

a pair of emergency stop posts disposed on either side of the bench, at a location proximate to the back frame assembly, the pair of emergency stop posts supports the pair of weight-bearing arms when the pair of support posts are positioned in the second, workout position.

14. A self-spotting exercise apparatus for simulating dumbbell exercises, the self-spotting exercise apparatus comprising:

a base frame assembly including:

a motion bar disposed in a horizontal position;

a pair of vertical support posts attached to opposing end terminations of the motion bar; and a foot-activated pedal attached to the motion bar for controlling the position of the pair of vertical support posts, the combination of the motion bar and foot-activated pedal providing the capability of performing exercises without assistance;

a bench disposed over the base frame and positioned such that the pair of vertical support posts are positioned at opposing side locations along the length of the bench;

a back frame assembly attached to a head-end of the bench; and a pair of adjustable-length weight-bearing arms, each adjustable-length weight-bearing arm including a double-hinge component attached to a proximal end thereof and coupled to the back frame assembly, each adjustable-length weight-bearing arm further including a weight plate support pin and an adjustable-position handgrip, both the weight plate support pin and the adjustable-position handgrip disposed in proximity to an opposing, proximal end of the weight-bearing arm, wherein each double-hinge component includes a first hinge allowing for vertical movement of the associated weight-bearing arm and a second hinge allowing for horizontal, rotational movement of the weight-bearing arm, a separate cross member attaching the first hinge to the second hinge in a manner such that the combination of the first and second hinges creates a free range of motion including rotational motion for the attached weight-bearing arm simulating dumbbell movement capability.

15. The self-spotting exercise apparatus as defined in claim 14, further comprising:

a pair of emergency stop posts disposed on either side of the bench, at a location proximate to the back frame assembly, the pair of emergency stop posts for supports the pair of adjustable-length weight-bearing arms when the pair of support posts are positioned in the second, workout position.

16. The self-spotting exercise apparatus as defined in claim 14 wherein the pair of adjustable-length weight-bearing arms comprises a pair of telescoping arms, each arm including at least two separate telescoping sections with a first telescoping section formed to move back and forth within the interior of a second telescoping section to adjust the overall length of the weight-bearing arm.

17. The self-spotting exercise apparatus as defined in claim 14 wherein each adjustable-position handgrip of the pair of adjustable-position handgrips comprises:

a circular plate attached to a handgrip location along the weight-bearing arm, the circular plate including a plurality of fitting position holes formed around an aperture thereof, wherein the handgrip is positioned over a central spindle attached to the circular plate; and a fixing pin attached to the handgrip and disposed to mate with a selected fitting position hole, wherein the fixing pin is rotated from location over one fitting position hole to another so as to adjust the position of the attached handgrip until an acceptable position of the handgrip with respect to the weight-bearing arm is achieved, the fixing pin thereafter inserted into the selected fitting position hole.

* * * * *